US006848728B2

(12) United States Patent
Rotondi et al.

(10) Patent No.: US 6,848,728 B2
(45) Date of Patent: Feb. 1, 2005

(54) WINDOW FASTENER

(76) Inventors: Anthony Rotondi, 216 N. Grove St., Owatonna, MN (US) 55060; Brian Dallmann, 2216 Hill Dr., Owatonna, MN (US) 55060; Tim Frenzen, 545 14th St. NE., Owatonna, MN (US) 55060; Clark Velzke, 6718 NW. 52 Ave., Medford, MN (US) 55049

( * ) Notice: Subject to any disclaimer, the term of this patent is extended or adjusted under 35 U.S.C. 154(b) by 0 days.

(21) Appl. No.: 10/404,151

(22) Filed: Apr. 1, 2003

(65) Prior Publication Data

US 2004/0195843 A1 Oct. 7, 2004

(51) Int. Cl.[7] ..... E05B 63/20
(52) U.S. Cl. ..... 292/336; 292/DIG. 31
(58) Field of Search ..... 292/332, 336, 292/DIG. 31, 336.3

(56) References Cited

U.S. PATENT DOCUMENTS 308,055 A * 11/1884 Buck ..... 292/336
359,119 A * 3/1887 Willcox ..... 292/336
557,134 A * 3/1896 Lowe ..... 292/336
739,410 A * 9/1903 Goerk ..... 292/336
959,559 A * 5/1910 Landis ..... 292/336
1,076,650 A * 10/1913 Eddy ..... 292/336
2,061,493 A * 11/1936 Tracy ..... 292/336
2,158,260 A * 5/1939 Stillman ..... 292/336
2,480,016 A * 8/1949 Granberg ..... 292/336

OTHER PUBLICATIONS

AMSCO, *StyleLock*, Mar. 2003, pp. 1.
Jeld–Wen/Milgard, New Sash Lock, Mar. 2003, pp. 1.
AMSCO Windows, *Components & Equipment, Fenestration*, Sep. 2002, pp. 1.
Doug Johnson, Truth Hardware Internal Correspondence, *Positive action lock via Vangard*, Mar. 4, 2003, pp. 2.

* cited by examiner

*Primary Examiner*—Gary Estremsky
(74) *Attorney, Agent, or Firm*—Patterson, Thuente, Skaar & Christensen, P.A.

(57) ABSTRACT

A window fastener for controlling the locking and unlocking of a window is disclosed. The fastener provides an unlocking feature that is manually activated by the user and a locking feature that is automatically activated as the window is moved substantially proximate to the closed position. The unlocking feature disengages the fastener from the window and maintains disengagement so that further manipulation of the fastener is not required to facilitate window opening. The fastener also provides a positive confirmation feature that informs the user that the window is either closed and locked or open and unlocked.

30 Claims, 9 Drawing Sheets

WINDOW FASTENER

BACKGROUND OF THE INVENTION

The present invention relates to window locks and fasteners, and more particularly, to automatic style window locks and fasteners.

In a typical window installation, a standard manually operated fastener is employed to lock and unlock the window. With this arrangement, an operator wishing to unlock and open the window must first release the fastener and then move the window to the open position. Conversely, to close and lock the window, the operator must move the window to the closed position and then re-latch the fastener to prevent the window from being opened from the exterior. This need to re-latch the fastener when the window is moved to the closed position presents a security problem because a window in the closed position can appear to be locked even though the fastener is not properly engaged.

To eliminate the need to re-latch and lock the window upon closure, "automatic snap" style window fasteners that provide automatic locking have been devised. However, these automatic fasteners complicate window opening because they require hand assistance; i.e., in order to unlock and open the window, the operator must in some way manipulate the fastener with one hand while simultaneously moving the window enough to overcome the automatic latching/locking means with the other hand. This hand assistance requirement not only makes it difficult to open the window, especially if an operator is physically incapable of doing such, but also presents a safety issue particularly in situations where a window needs to be opened quickly and effortlessly for emergency egress.

An additional problem common to both standard manually operated fasteners and "automatic snap" style fasteners is that neither offers a visual indicator that positively confirms that the attached window is unequivocally locked and secure. This lack of visual confirmation presents a security problem because a window can easily appear to be fully closed and fully locked when in fact it is not, which can occur from operator negligence and/or fastener malfunction.

For the foregoing reasons, there is a need for a window fastener that locks automatically upon window closure, does not require hand assistance to overcome latching and locking, and furthermore, offers positive visual confirmation so that a person knows with certainty that the attached window is fully closed, locked, and secured against unwanted entry.

SUMMARY OF INVENTION

The present invention is directed to a window fastener that is particularly suitable for use with horizontal and vertical style sliding windows.

According to an aspect of the invention, there is provided an unlocking feature that eliminates the need for hand assistance during window opening because once the unlocking feature is actuated to unlock a window, the window fastener will remain in an unlocked condition regardless of whether the window is moved, thereby freeing up both of the operator's hands to move the window.

According to another aspect of the invention, there is provided a locking feature, which will automatically lock a window when the window is moved to the fully closed position and the fastener is properly aligned to engage the window.

According to still another aspect of the invention, there is provided a positive confirmation feature (confirming indicator) that conveys to a person viewing the window and lock from several feet away (or a visually impaired person touching the fastener) with certainty that the window is closed and locked—not by merely noting that the window appears closed and locked, but by viewing (or if visually impaired, feeling) a positive indicator or representation on the fastener that clearly and unequivocally signifies that the window is closed and locked.

The window fastener herein described and comprising the abovementioned features comprises a housing having a front surface defining a front opening, a rear is surface defining a rear opening, a top surface and a bottom surface. A depressible pushlever comprising a pivot end and a nonpivot end is pivotally secured to the housing at the pivot end, which allows the pushlever to pivot through the front opening of the housing between a depressed position, wherein the nonpivot end is substantially flush to the front surface of the housing, and a protruding position, wherein the nonpivot end outwardly protrudes from the front surface of the housing.

The position of the pushlever acts as the confirming indicator (noted above), wherein the depressed position indicates a first condition of the window fastener and window position and the protruding position indicates a second condition of the window fastener and window position. Depending on the exact configuration of the window fastener, the first condition can equate to the window fastener being in a locked condition and the window closed, while the second condition can equate to the window fastener being in the unlocked position and the window open (or slightly ajar), or visa versa.

The window fastener further comprises: a lock bolt pivotally secured to the housing and operatively coupled to the pushlever, wherein the lock bolt pivots between a latching position and an unlatching position through the rear opening of the housing; a latch pivotally secured within the housing, wherein the latch releasably engages the pushlever at one end; and a trigger rotatably supported within the housing, wherein the trigger rotatably engages the latch. The fastener further comprises: a first biasing element to bias the pushlever towards the protruding position; a second biasing element to bias the trigger towards a resting position; and a bottom plate removably fitted to the bottom surface of the housing.

The window fastener is typically attached to a window installation (although it could be used with a door or gate) having a window movable between a window open position and a window closed position, wherein the fastener, once set in the unlocked condition, will disengage the window and remain in the unlocked condition while the window is in the window open position, and wherein the fastener will automatically switch to the locked position and engage the window when the window contacts and rotates the trigger as it nears the window closed position.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

Figure 1:
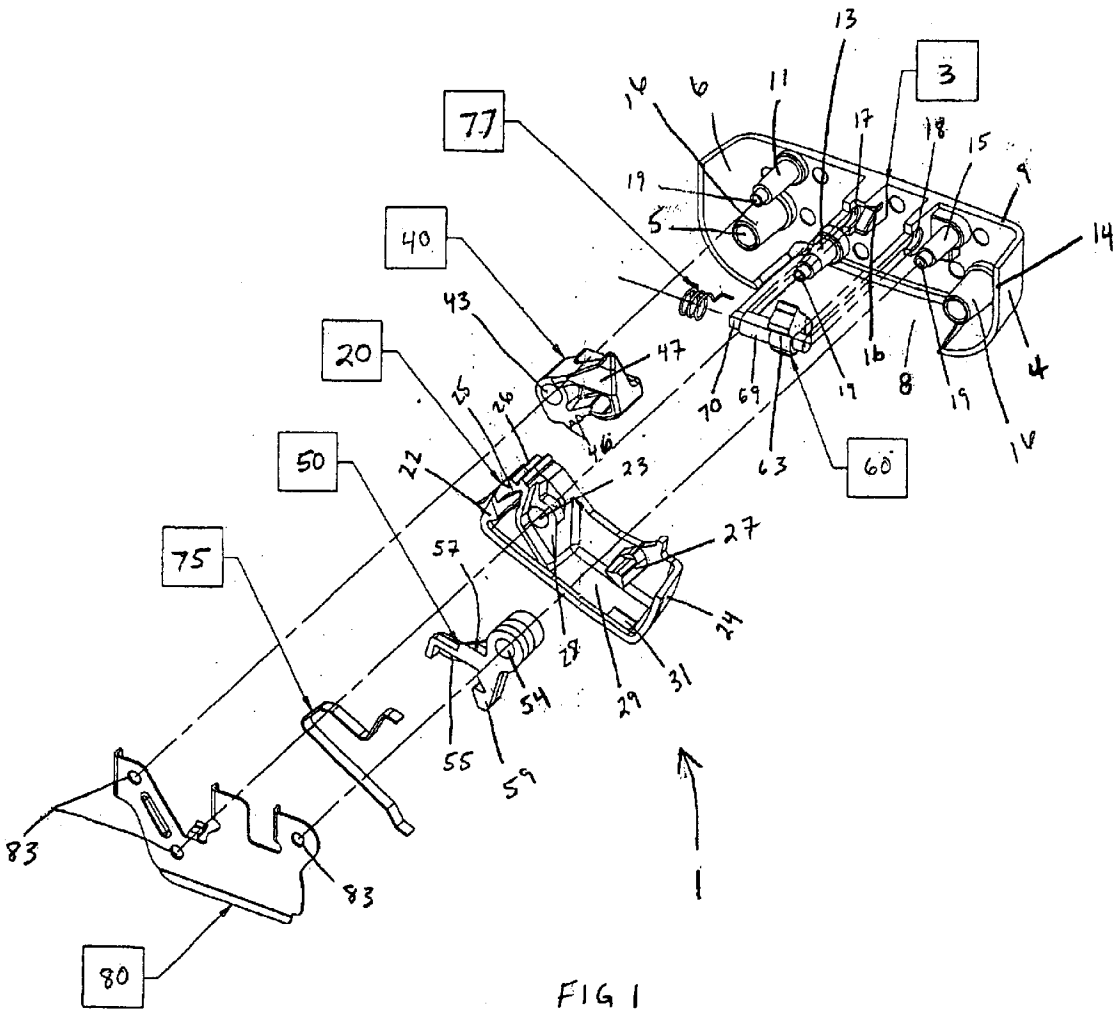
FIG. 1 is an exploded isometric view of the window fastener.
Figure 2:
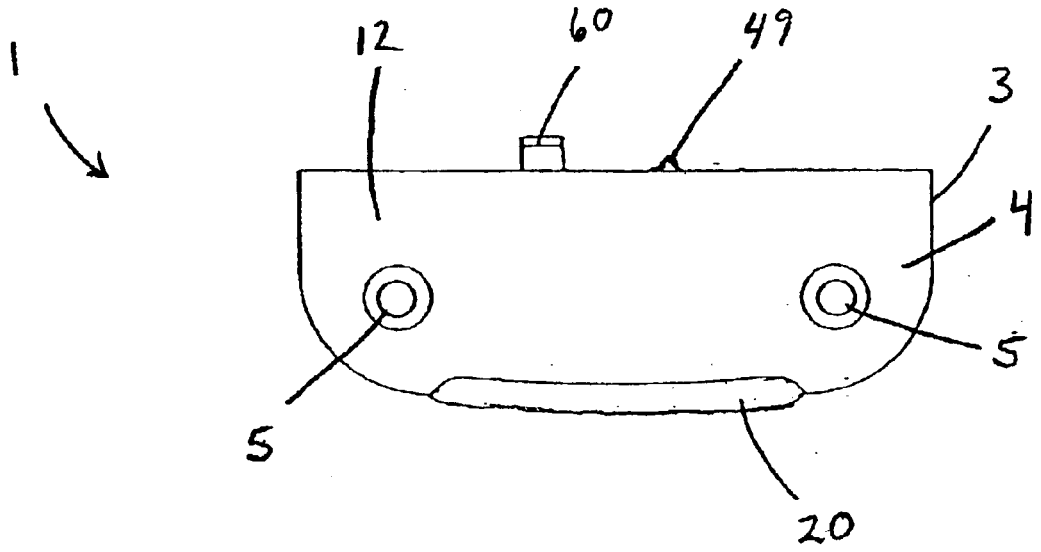
FIG. 2 is a top view of the window fastener in the unlocked condition.
Figure 3:
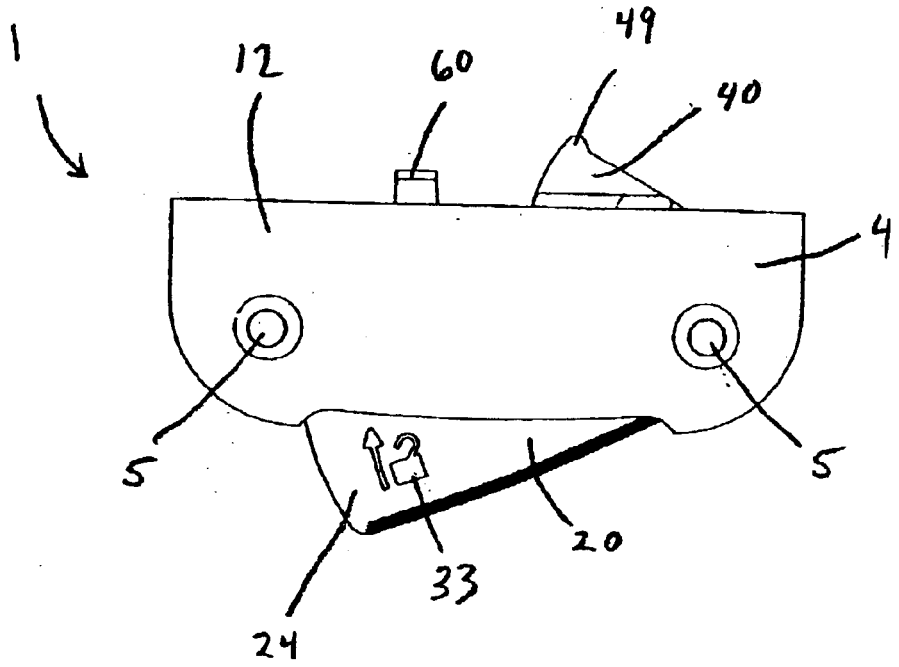
FIG. 3 is a top view of the window fastener in the locked condition.
Figure 4:
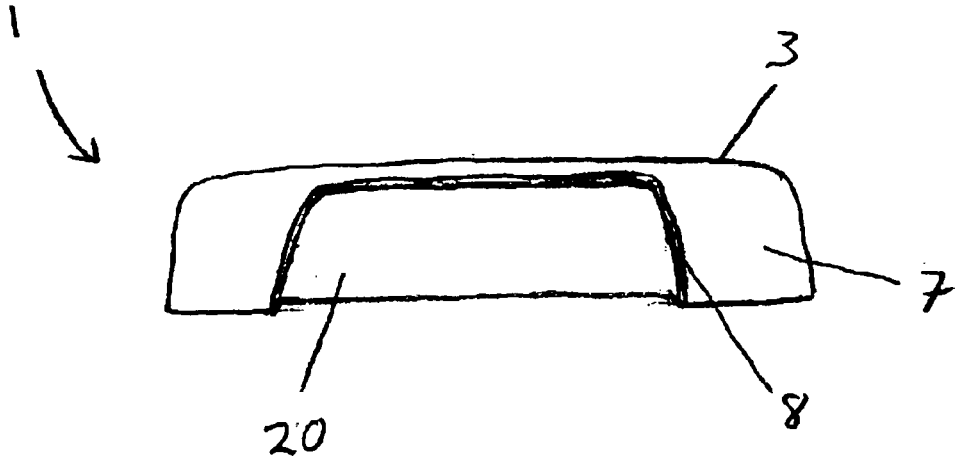
FIG. 4 is a front view of the window fastener.
Figure 5:
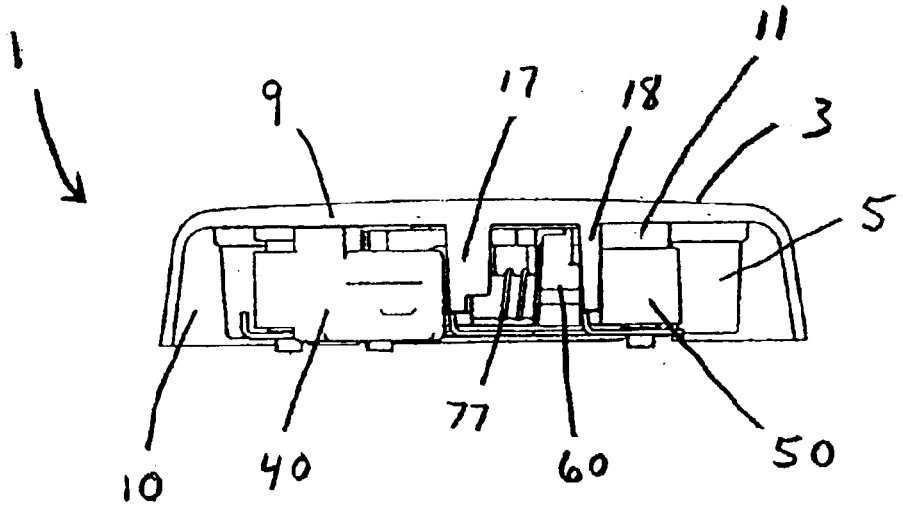
FIG. 5 is a rear view of the window fastener.

Referring now to the drawings, and more particularly to FIG. 1, an embodiment of the window fastener 1 adaptable for windows, and more particularly to vertical and horizontal sliding windows. It should be noted, however, that the fastener is also adaptable with rotating casement type windows and various door and gate configurations. It should also be noted that the parts herein described can be made from any and all suitable materials such as plastics, metals or any combination thereof, so long as the functioning aspects of the window fastener 1 are not compromised.

The window fastener 1 comprises a housing 3, pushlever 20, a lock bolt 40, a latch 50, a trigger 60, a first biasing element 75, a second biasing element 77, and a bottom plate 80. Optionally, the lock also comprises a separate keeper 90, mounted to windows that do not already comprise window fastener engagement means such as an integrated slot in the window frame or extrusion to engage the lock bolt 40. Once assembled, the window fastener 1 provides both a locking feature and an unlocking features. The unlocking feature actuated by the pushlever 20, is designed so that once actuated, the fastener is set in an unlocked condition (FIG. 7) and will remain in the unlocked condition, thereby eliminating the need for the user to further manipulate or work the fastener to overcome its the engagement while at the same time trying to open the window. The locking feature actuated by the trigger 60, is fully automatic wherein the fastener 1 will engage and lock the window automatically when the window is moved to the near closed position, eliminating the need for the user to further manipulate or work the fastener 1 to lock the window. Additionally, the window fastener provides a positive confirmation feature that indicates/confirms with certainty whether the fastener is in the locked (window is completely closed and locked) condition (FIG. 6) or unlocked (window is open and unlocked) condition (FIG. 7). The physical position of the pushlever 20 provides visual and tactile confirmation of the locked or unlocked status of the window fastener. The positioning of the pushlever 20 is described in further detail below.

Attention will now be drawn to a more detailed description of the abovementioned components of the window fastener 1. The housing 3, shown in FIGS. 1–7, is the main assembly enclosure of the window fastener 1. The housing 3 has an outer portion 4, an inner portion 6, a front surface 7 having a front opening 8, a rear surface 9 having a rear opening 10, a top surface 12 and a bottom surface 14. The outer portion 4 is capable being aesthetically configured (e.g., contoured shaped and colored) to coincide with the particular interior decor requirements of a given user. The top surface 12 further defines at least two thru holes 5 for receiving mounting hardware, such as screws (not shown), to secure the window fastener to a window frame (not shown). The inner portion 6 is configured as an assembly platform to capture and support the working components of the lock (except for the optional keeper). The inner portion 6 comprises a series of posts including a lock bolt post 11 for receiving the lock bolt 40, a pushlever post 13 for receiving the pushlever 20, a latch post 15 for receiving the latch 50 and at least two mounting posts that further define the thru holes 5. The pushlever post 11, lock bolt post 13 and latch post 15 each define fastener receiving holes 19 that align with coinciding fastener holes 83 defined in the bottom plate 80 for receiving fasteners, such as screws (not shown), to secure the bottom plate 80 to the housing 3 during assembly. The inner portion 6 further comprises at least two saddles 17 and 18, wherein the saddles rotatably support the trigger 60 and wherein at least one of the saddles has a slot 16 that secures one end of the second biasing element 77. Additionally, the inner portion 6 has portions defining a front opening 7 to allow at least the pushlever 20 to pivot and protrude as necessary and a rear opening 9 to allow at least the lock bolt 40 and the trigger 60 to pivot and protrude as necessary.

The pushlever 20, shown in FIGS. 1–3, and 5–8, is a depressible pushlever comprising an outside surface 30 having a push surface 21, a gear portion 25, a pivot end 22 and a nonpivot end 24. The push surface 21 is configured to have an aesthetic yet functional shape to meet the demands of being repeatedly pressed by the operator desiring to open/unlock and close/lock the window to which the window fastener 1 is mounted. The gear portion 25 comprises at least two gear teeth 26 and engages a mating gear portion 45 on the lock bolt 40 described in more detail below. The push lever includes an inner cavity 29 having a raised ridge 27 that extends perpendicular to the top surface, and a pivot portion 28 through which a pushlever pivot hole 23 is defined. The raised ridge 27 provides an interlocking means to enable the latch 50 to grasp and engage the pushlever 20 during operation. The pushlever pivot hole 23 is adapted to receive the pushlever post 13 so that the pushlever 20 is pivotally mounted about the post 13 and freely pivotable about its pivot end 22 through the front opening 8 of the housing 3 between a depressed position and a protruding position. In a depressed position, the nonpivot end 24 is substantially flush to the front surface of the housing 7 (FIGS. 2, 5, and 7) and provides positive confirmation that the window fastener 1 is set in a first condition. In a protruding position (FIGS. 3 and 6), the nonpivot end 24 outwardly protrudes from the front surface 7 of the housing 3 and provides positive confirmation that the window fastener 1 is set in a second condition. In one embodiment, the first condition is the unlocked condition of the window fastener 1, wherein the window is open and unlocked, while the second condition is the locked condition of the window fastener 1, wherein the window is fully closed and locked. Alternatively, the first condition can equate to the locked condition and the second condition can equate to the unlocked condition. The inner cavity 6 also has a flat surface portion 31 designed to trap/receive one end of the first biasing element 75. Optionally scribed on a portion of the outside surface is at least one symbol 33 indicating the direction the pushlever 20 needs to be moved to either lock or unlock the window. The pushlever 20 is further configured to freely pivot a desired angle of rotation while being confined when the bottom plate 80 is in place.

The lock bolt 40, shown in FIGS. 1, 3, 4, 6, 7, and 10*a–b*, comprises a lock bolt pivot hole 43 defined at one end. The pivot hole 43 is adapted to receive the lock bolt post 11 so that the lock bolt 40 is free to pivot between a latched/extended position (FIGS. 3 and 6) when the window is closed and locked and an unlatched/recessed position (FIGS. 4 and 7) when the window is open and unlocked. At the other end of the lock bolt 40 is an engaging portion 47, which in one embodiment comprises a tapered surface 48 and a raised lip 49, which are designed to engage a slot in the window or keeper to act as the locking key. Additionally, the lock bolt 40 has a gear portion 45, which engages the gear portion 25 of the pushlever 20, wherein any movement of the pushlever 20 will cause the lock bolt 40 to move in concert. The gear portion 45 comprises at least two gear teeth 46 which engage the corresponding gear teeth 26 on the pushlever 20. The lock bolt 40 is configured to freely pivot a desired angle of rotation while being confined when the bottom plate 80 is attached.

The latch 50, shown in FIGS. 1, 4, 6, 7, and 9, comprises three end portions. The first end portion 51, defines a latch pivot hole 54, wherein the latch pivot hole 54 is sized to receive the latch post 15 of the housing 3 so that the latch 50 is able to freely pivot about the latch post 15. The second end portion 52 comprises a curved taper surface 57 that engages and cams over when the trigger 60 (described below) pivots. The curved taper surface 57 is designed to interact with the trigger 60, so when the trigger 60 rotates to a position to engage the latch 50, the latch will rotate a desired angle of rotation. In one embodiment, the angle of rotation of the latch 50 and trigger 60 occurs at perpendicular planes. The second end portion 52 also comprises a support surface 55 for the purpose of trapping/receiving one end of the first biasing element 75, opposite the end trapped/received by the pushlever 20. Lastly, the third end portion 53 of the latch 50 comprises a hooking apparatus 59 that is designed to engage (FIG. 7) and disengage (FIG. 6) the raised ridge 27 on the pushlever 20 as noted above.

The trigger 60, shown in FIGS. 1–4, 6, 7, and 11*a–b*, comprises a two sided cam portion 63 and a shaft portion 69 having end portions 70, wherein the end portions 70 are cradled in the support saddles 17 and 18 of the housing 3 so that the trigger 60 is able to freely pivot or rotate a desired angle of rotation in either direction. The rotational movement of the trigger 60 is initiated by direct contact with an edge of a slot of a moving window frame (or slot of a keeper mounted to the frame), not shown, and the direction of rotation coincides with the direction of window movement. For example, in one embodiment, movement of the window towards an open position (i.e., opening the window) causes the trigger 60 to rotate away from the latch 50 so that no contact is made with the latch and the latch does not move, while movement of the window frame towards the closed position (i.e., closing the window) causes the trigger 60 to rotate in the opposite direction causing the trigger and latch to cam together (engage) and rotate together. The cam portion 63 has two distinct sides, namely a first side 65 and a second side 67, wherein the first side 65 is configured to interact with the latch 50 so that the trigger 60 and latch 50 rotate on a perpendicular plane. The second side 67 of the cam portion is configured to interact with the slot in the window or keeper. To further secure the second biasing element 77, a slot is provided in the cam portion 63 of the trigger 60, wherein the slot secures the end of the second biasing element opposite the end that is fixedly secured in the housing 3 (as noted above).

Figure 6:
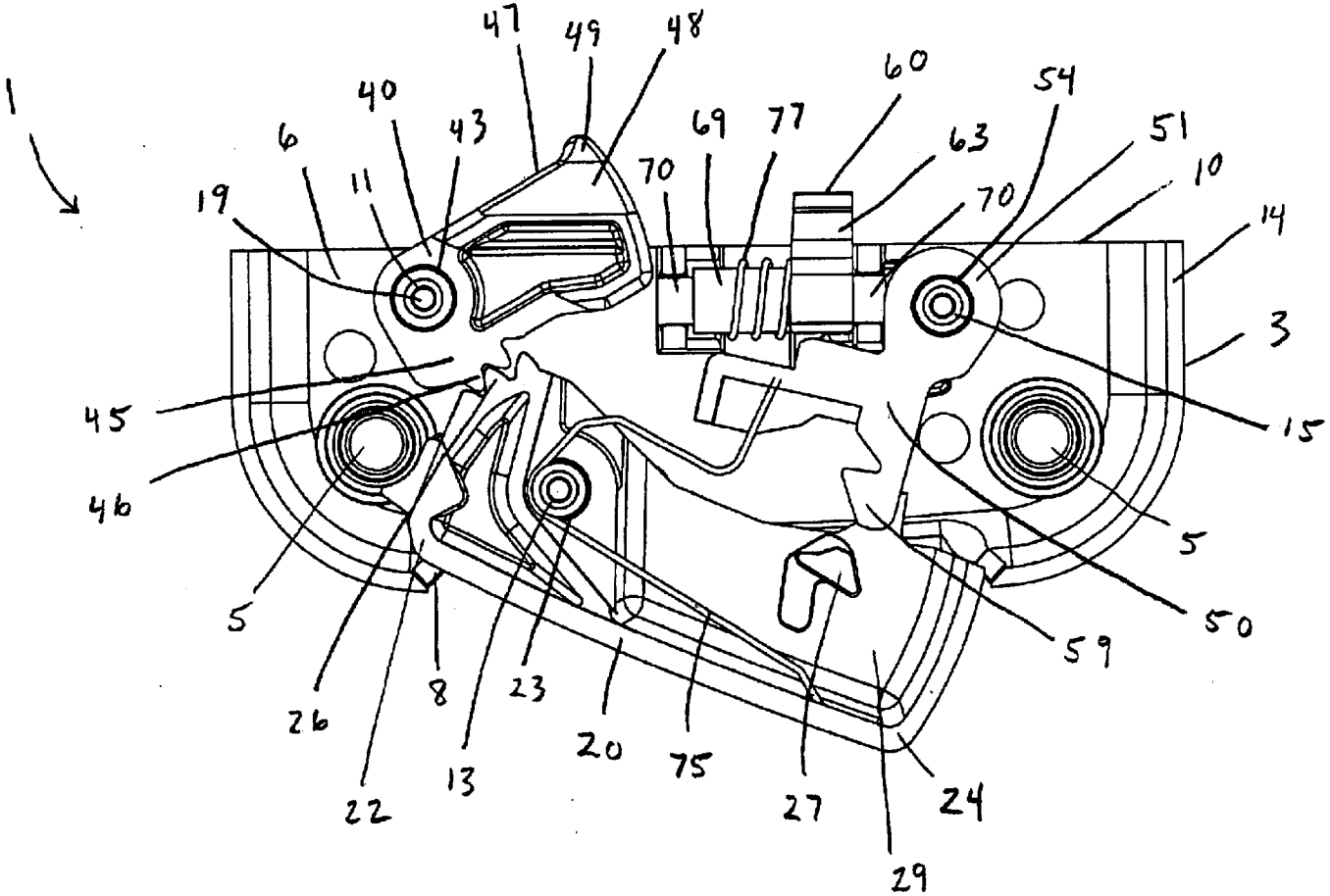
FIG. 6 is a bottom view of the window fastener in the locked condition with the bottom plate removed.
Figure 7:
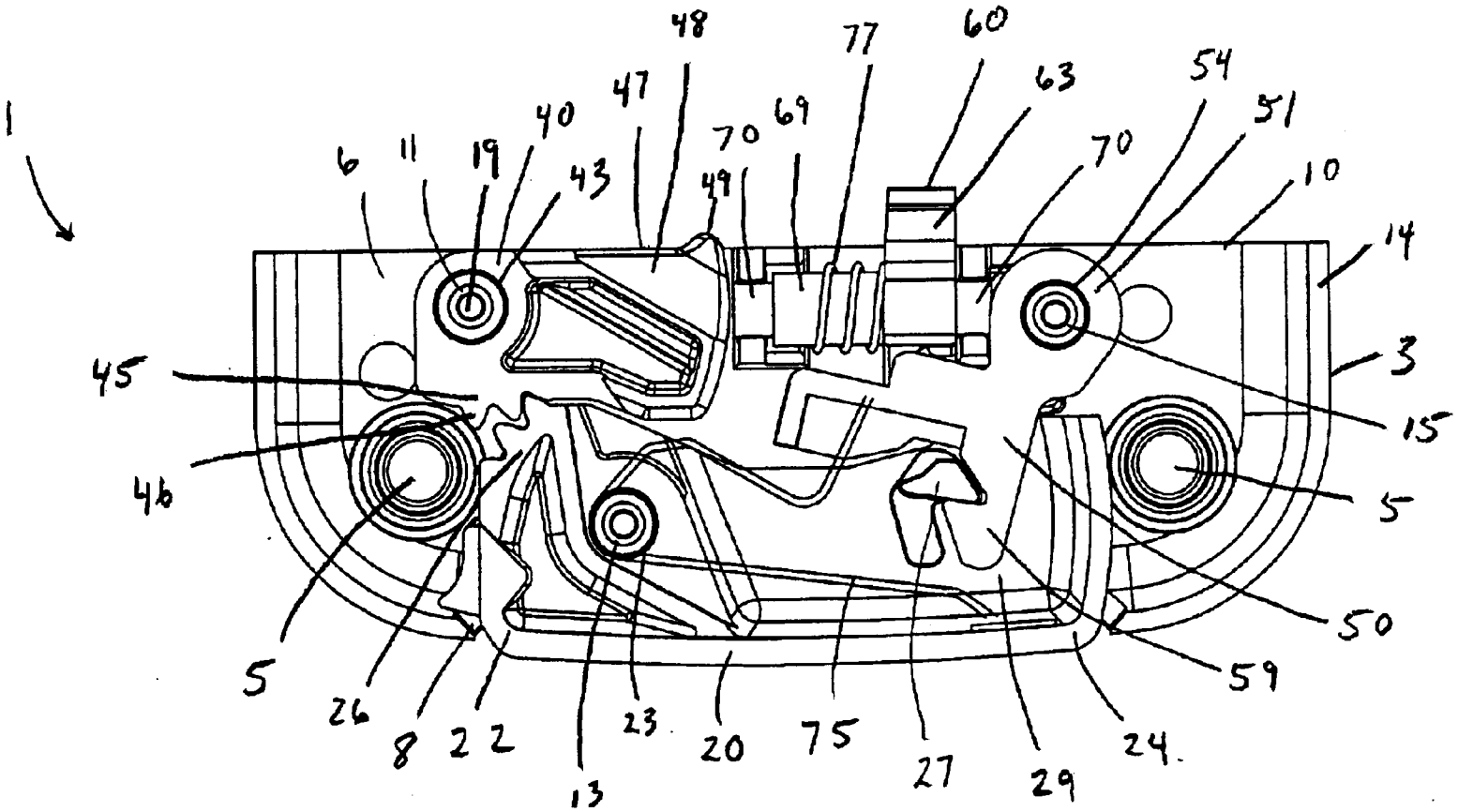
FIG. 7 is a bottom view of the window fastener in the unlocked condition with the bottom plate removed.
Figure 8:
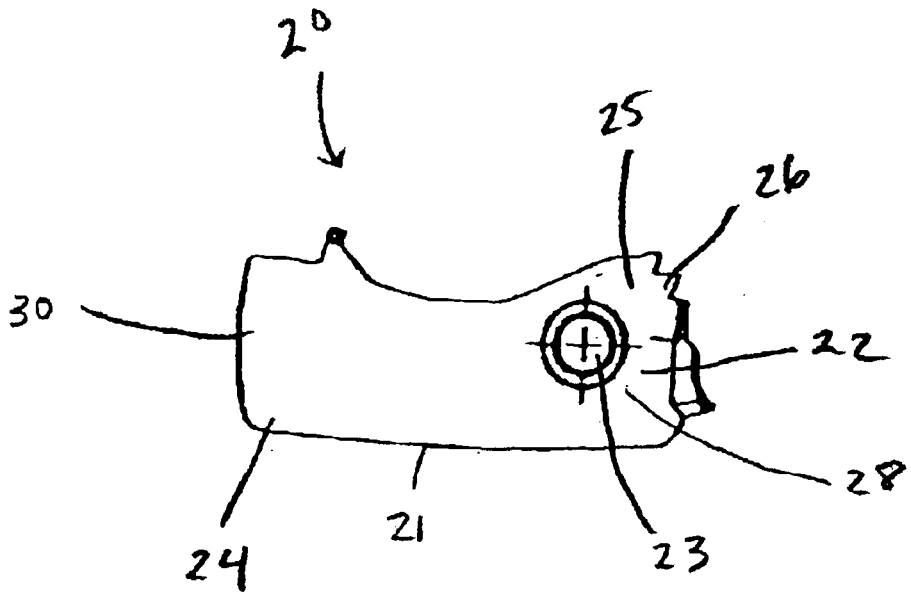
FIG. 8 is a top view of the pushlever.
Figure 9:
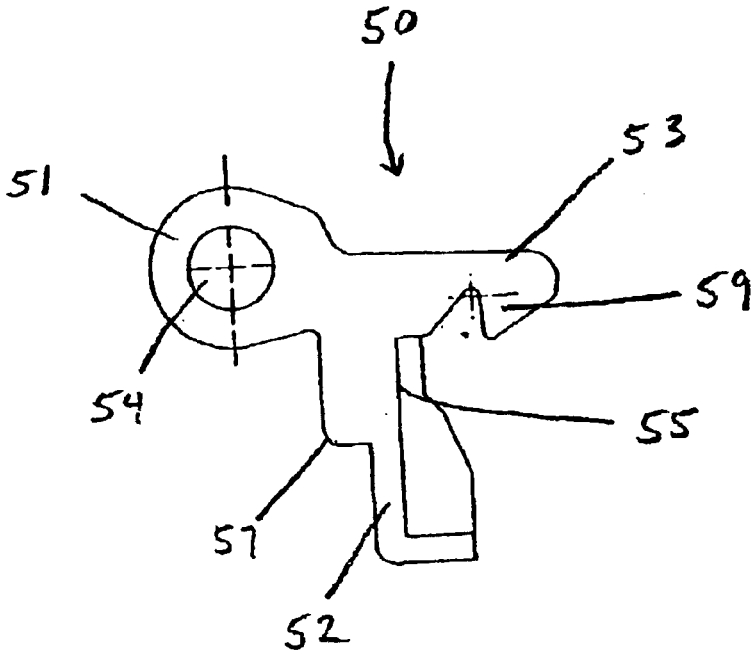
FIG. 9 is a top view of the latch.
Figure 10A:
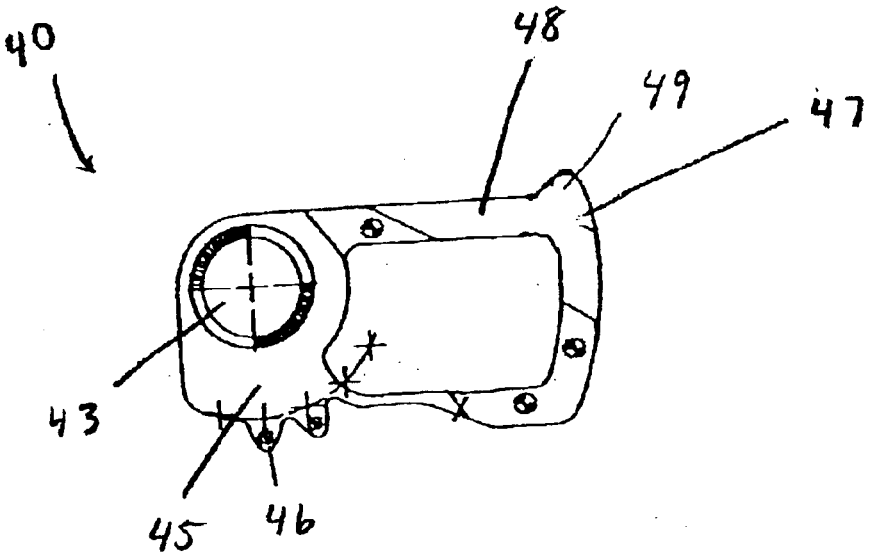
FIG. 10*a* is a top view of the lock bolt.
Figure 10B:
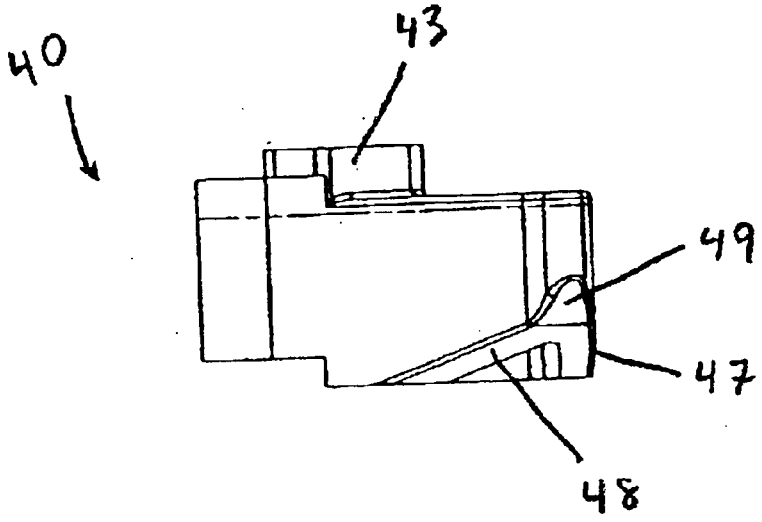
FIG. 10*b* is a side view of the lock bolt.
Figure 11A:
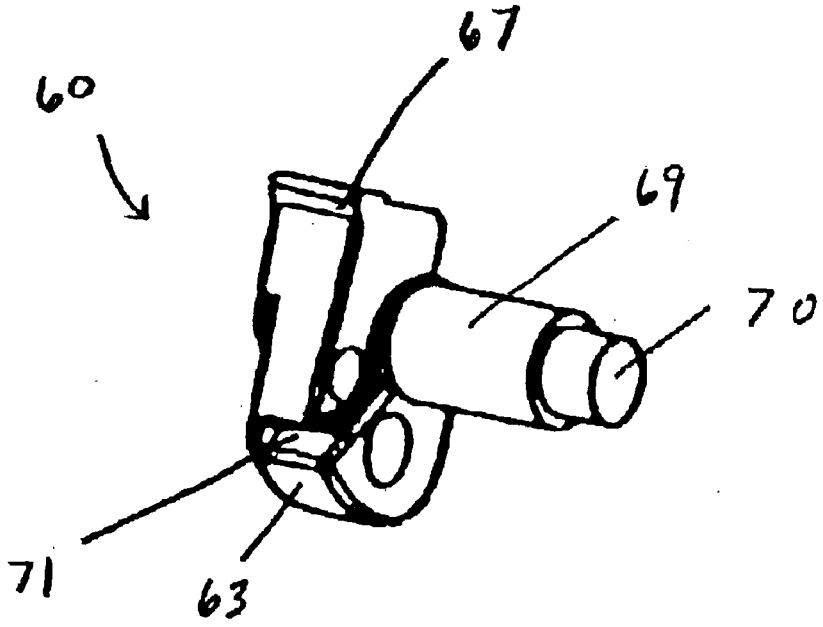
FIG. 11*a* is an isometric view of the trigger.
Figure 11B:
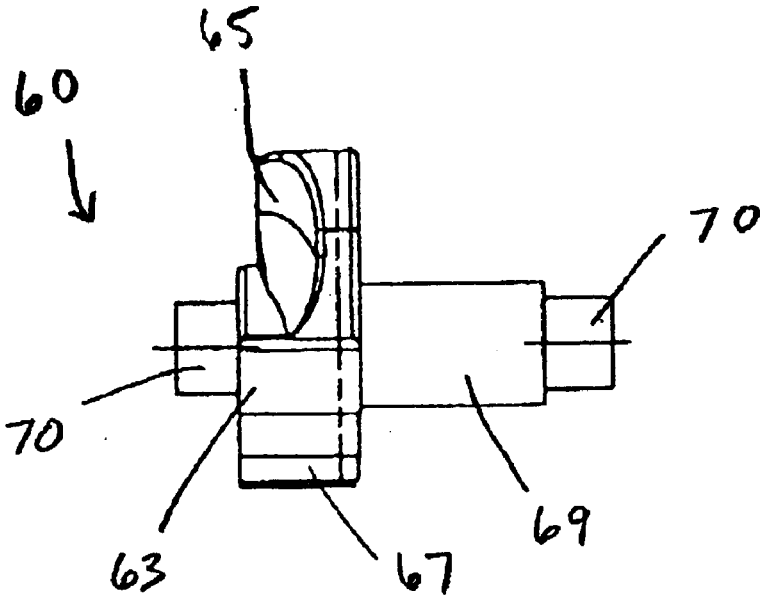
FIG. 11*b* is a top view of the trigger.

The first biasing element 75, shown in FIGS. 1, 6, and 7, is an elastic spring-type member, such as a leaf spring, or other suitable elastic/spring means, positioned and compressed (FIG. 7) between the latch 50 and pushlever 20. The first biasing element 75 is used to create and store the necessary energy required to urge or bias the pushlever 20 towards the protruding position and also to urge or bias the latch 50 towards engagement with the pushlever 20. To further secure the first biasing element 75 in place within the housing 3, the element is positioned around the pushlever post 13.

The second biasing element 77, shown in FIGS. 1, 4, 6 and 7, is an elastic spring-type member, such as a coil spring, or other suitable elastic/spring means. In one embodiment, the second biasing element 77 is a thin wire coil spring configured for placement onto the shaft portion 69 of the trigger 60, with one free end engaging into a slot in the cam portion 63 of the trigger 60, and the other free end engaging into a slot provided in one of the support saddles of the housing 3, which in one embodiment is support saddle 17. The second biasing member 77 is designed to create and store the necessary energy required to hold and return or bias the trigger 60 to a center or rest position regardless of which direction the trigger is rotated by moving the window.

To secure the various components to the housing 3, a bottom plate 80, shown in FIG. 1), is employed. The bottom plate 80 has at least one fastener hole 83 that aligns with at least one of the housings posts 11,13,15 to removably attach the bottom plate 80 to the housing 3. The bottom plate 80 is configured so that is can be fitted over the three posts of the housing 3 and rest on the posts' shoulders, trapping the above components with the desired clearance into the housing 3 when attached so that the components are able to function without interference from the plate 80.

Figure 12:
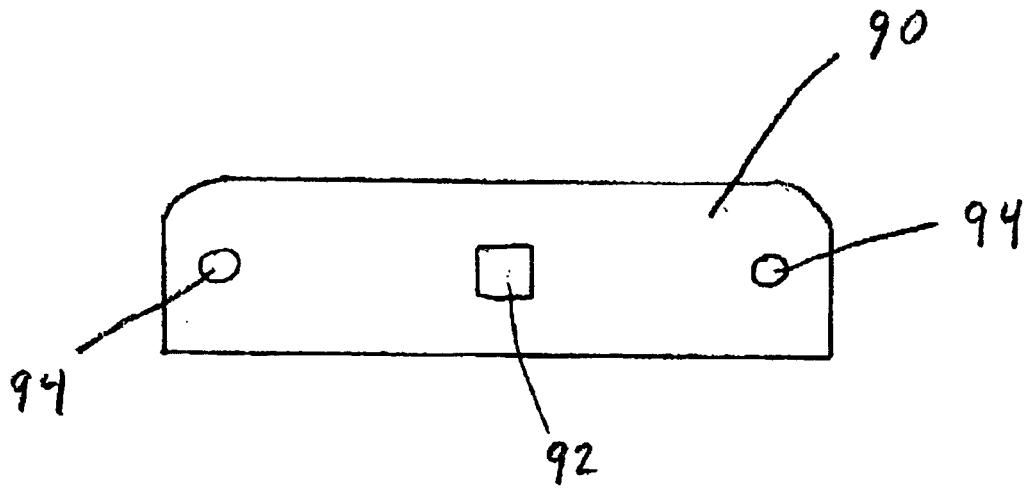
FIG. 12 is a front view of the optional keeper.

As noted above, for windows with frames not capable of engagement with the window fastener 1, an optional keeper 90, shown in FIG. 12, is provided. The keeper 90 mounts to the window frame via at least one mounting hole 94 and has a slot 92 that is adapted to receive and engage the lock bolt 40 of the fastener 1 for secure window locking.

Having thus described the components of the window fastener 1, attention will now be drawn to one example of its operation. Starting with the window closed (and locked) and the window fastener 1 in the locked condition (FIG. 6), a user desiring to unlock and open the window (not shown), depresses the pushlever 20 to actuate the unlocking feature. This causes the pushlever to pivot about the pushlever post 13 so that the raised ridge 27 engages the latch hook 59 further causing the pushlever 20 to be set in the depressed position wherein the nonpivot end 24 is held flush to the front surface 7 of the housing 3. Setting the pushlever 20 in the depressed position compresses the first biasing member 75 and pivots the lock bolt 40 from the latched position to the unlatched position, which places the fastener 1 in the unlocked condition (FIG. 7).

If at any time the nonpivot end 24 of the pushlever 20 is held flush to the front surface 7 of the housing 3, the pushlever 20 is in the depressed position and provides positive confirmation that the fastener 1 is in the unlocked condition, and hence, the window (not shown) is not fully closed and locked. The position of the nonpivot end confirms to the user via visual representation or feel that the fastener is either in the unlocked position wherein the window is open and unlocked or the locked position wherein the window is fully closed and locked.

Once in the unlocked condition (FIG. 7), the user is then able to open the window and move it to the desired window open position with either one or both hands (user's is choice) without having to further manipulate the window fastener 1 during window opening for any reason, including having to overcome the latching engagement between the window fastener 1 and the window. As the window is moved away from the fully closed position and away from the locking slot (not shown) of the window frame or slot 92 in the keeper 90, the window frame or keeper will contact the trigger 60 causing it to rotate in a first direction, which will not actuate the locking feature. And therefore, the nonpivot end 24 of the pushlever 20 will remain flush to the housing 3 representing that the fastener is still in the unlocked condition.

When the user desires to close and lock the window, the window is moved back towards the closed position and towards the locking slot of the window or slot 92 of the keeper 90. When the window is substantially proximate to the closed position, the trigger 60 will come into contact with an edge of the slot of the window frame or slot in the keeper and begin rotating (cam over) in a second direction opposite the first direction, which will actuate the automatic feature of the window fastener 1.

Actuation occurs as the rotating trigger 60 rotates the latch 50 so that the latch hook 59 disengages and releases the raised ridge 27 of the pushlever 20. This allows the first biasing element 75 to decompress and apply a force to the pushlever 20 causing the pushlever 20 to pivot from the depressed position to the protruding position. As the pushlever 20 pivots, it engages the lock bolt 40 so that the lock bolt 40 pivots/rotates from the unlatching position to the latching position and engages the window fastener engaging means, such as a slot in the window frame or extrusion (not shown) or the slot 92 in the keeper 90. The lock bolt 40, however, will not engage the window fastener engaging means until the lock bolt 40 is properly aligned with the engaging means to assure that the window is truly locked.

When the lock bolt 40 engages the window fastener engaging means, the nonpivot end 24 of the pushlever 20 is set in the protruding position, which provides positive confirmation to the user (as noted above) that the fastener is in the locked condition (FIG. 6) and the window is fully closed and locked. It should be noted that if the nonpivot end 24 of the pushlever 20 does not extend or protrude out from the housing 3 to the protruding position, the window is not fully closed and locked even if it appears to be fully closed and locked. This assures that the positive confirmation feature is accurate and will not indicate that an unlocked window is indeed locked.

Throughout the operative unlocking and locking functions of the window fastener 1, particularly the automatic function, the first and second biasing elements, 75 and 77 respectively, generate and store the necessary energy required to return, re-set and re-latch all the components for successful and reliable locking and unlocking of the window.

Although the present invention has been described in considerable detail, it will be appreciated that additional advantages and modifications will be readily apparent to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A window fastener comprising:

a housing having a front surface defining a front opening, a rear surface defining a rear opening, a top surface and a bottom surface;

a depressible pushlever comprising a pivot end and a nonpivot end, the pushlever being pivotally secured to the housing at the pivot end, wherein the pushlever pivots through the front opening of the housing between a depressed position wherein the nonpivot end is substantially flush to the front surface of the housing providing positive confirmation that the window fastener is set in a first condition, and a protruding position wherein the nonpivot end outwardly protrudes from the front surface of the housing providing positive confirmation that the window fastener is set in a second condition;

a latch pivotally secured within the housing, wherein the latch releasably engages the pushlever at one end;

a trigger rotatably supported within the housing, wherein the trigger rotatably engages the latch;

a first biasing element to bias the pushlever towards the protruding position;

a second biasing element to bias the trigger towards a resting position; and a bottom plate removably fitted to the bottom surface of the housing.

2. The window fastener of claim 1, wherein the first condition is an unlocked condition and the second condition is a locked condition.

3. The window fastener of claim 2, wherein the fastener is attached to a window installation having a window movable between a window open position and a window closed position, wherein the fastener, once set in the unlocked condition, will disengage the window and remain in the unlocked condition while the window is in the window open position, and wherein the fastener will automatically switch to the locked condition and engage the window when the window contacts and rotates the trigger as it moves substantially proximate to the window closed position.

4. The window fastener of claim 3, wherein the trigger engages the latch when rotating in a first direction with respect to the resting position and does not engage the latch when rotating in a direction opposite the first direction with respect to the resting position.

5. The window fastener of claim 1, wherein the first condition is a locked condition and a second condition is an unlocked condition.

6. The window fastener of claim 5, wherein the fastener is attached to a window installation having a window movable between a window open position and a window closed position, wherein the fastener, once set in the unlocked condition, will disengage the window and remain in the unlocked condition while the window is in the window open position, and wherein the fastener will automatically switch to the locked condition and engage the window when the window contacts and rotates the trigger as it moves substantially proximate to the window closed position.

7. The window fastener of claim 6, wherein the trigger engages the latch when rotating in a first direction with respect to the resting position and does not engage the latch when rotating in a direction opposite the first direction with respect to the resting position.

8. The window fastener of claim 1, wherein at least two mounting holes are defined in the top surface of the housing.

9. The window fastener of claim 1, wherein the lock bolt includes a lip portion intended for engaging with an edge of a window frame.

10. The window fastener of claim 1, wherein the lock bolt includes a lip portion intended for engageing a keeper attached to a window frame.

11. The window fastener of claim 1, wherein the first biasing element is a leaf spring and the second biasing element is a coil spring.

12. A window fastener, wherein the window fastener employs a locking feature and an unlocking feature, the window fastener comprising:

a housing having a front surface defining a front opening a rear surface defining a rear opening, a top surface and a bottom surface;

a depressible pushlever for actuating the unlocking feature, the pushlever comprising a hook portion, a pivot end and a nonpivot end, the pushlever being pivotally secured within the housing at the pivot end, wherein the pushlever pivots through the front opening of the housing between a depressed position wherein the nonpivot end is substantially flush to the front surface of the housing providing positive indicating that the window fastener is set in a first condition, and a protruding position wherein the nonpivot end outwardly protrudes from the front surface of the housing indicating that the window fastener is set in a second condition;

a lock bolt pivotally secured within the housing, wherein the lock bolt pivots between an extended position and a retracted position through the rear opening of the housing, and wherein the lock bolt is driven by the pushlever so that the lock bolt is in the extended position when the pushlever is in the protruding position and the lock bolt is in the retracted position when the pushlever is in the depressed position;

a trigger for actuating the locking feature, the trigger comprising a shaft portion and a cam portion, wherein the trigger is rotatably supported within the housing so that the trigger, starting from a rest position, is able to rotate in either a first direction or a second direction opposite the first direction;

a latch pivotally secured within the housing, the latch having a portion that engages the hook portion of the pushlever when the pushlever is in the depressed position, and a portion for engaging the cam portion of the trigger, wherein rotation of the trigger and cam portion causes the latch to pivot, which in turn disengages the latch from the hook portion of the pushlever, a first biasing element positioned between the pushlever and the latch, wherein the biasing element forces the pushlever to pivot from the depressed position to the protruding position when the latch disengages the hook portion of the pushlever, a second biasing element disposed over the shaft portion of the trigger and connected to the trigger at one end and the housing at another end, wherein the second biasing element returns the trigger to the rest position after the trigger is rotated in either the first direction or second direction; and a bottom plate removably fitted to the bottom surface of the housing.

13. The window fastener of claim 12, wherein the first condition is an unlocked condition and the second condition is a locked condition.

14. The window fastener of claims 13, wherein the fastener is attached to a window installation having a window movable between a window open position and a window closed position, wherein the fastener, once set in the unlocked condition, will disengage the window and remain in the unlocked condition while the window is in the window open position, and wherein the fastener will automatically switch to the locked condition and engage the window when the window rotates the trigger as it moves substantially proximate to the window closed position.

15. The window fastener of claim 14, wherein the trigger engages the latch when rotating in a first direction with respect to the resting position and does not engage the latch when rotating in a direction opposite the first direction with respect to the resting position.

16. The window fastener of claim 12, wherein the first condition is a locked condition and a second condition is an unlocked condition.

17. The window fastener of claim 16, wherein the fastener is attached to a window installation having a window movable between a window open position and a window closed position, wherein the fastener, once set in the unlocked condition, will disengage the window and remain in the unlocked condition while the window is in the window open position, and wherein the fastener will automatically switch to the locked condition and engage the window when the window contacts the trigger as it moves substantially proximate to the window closed position.

18. The window fastener of claim 17, wherein the trigger engages the latch when rotating in a first direction with respect to the resting position and does not engage the latch when rotating in a direction opposite that first direction with respect to the resting position.

19. The window fastener of claim 12, wherein at least two mounting holes are defined in the top surface of the housing.

20. The window fastener of claim 12, wherein the lock bolt includes a lip portion intended for engaging with an edge of a window frame.

21. The window fastener of claim 12, wherein the lock bolt includes a lip portion intended for engaging a keeper attached to a window frame.

22. The window fastener of claim 12, wherein the first biasing element is leaf spring and the second biasing element is a coil spring.

23. An automatic locking fastener for a window, door, or gate comprising:

a housing having a front opening and a rear opening, a manually operable pushlever in the front opening of the housing, the pushlever having a pair of opposing ends, the pushlever selectively shiftable between a first position wherein the pushlever is substantially within the housing and a second position wherein at least one of the opposing ends protrudes from the housing through the front opening;

a selectively releasable latch for latching the pushlever in the first position;

a first biasing element operably coupled with the pushlever and arranged to bias the pushlever toward the second position;

a lock bolt in the rear opening of the housing, the lock bolt operably coupled with the pushlever and selectively shiftable by the pushlever between a locked position wherein a portion of the lock bolt protrudes through the rear opening of the housing and an unlocked position wherein the lock bolt is substantially within the housing; and an operable trigger in the rear opening of the housing for releasing the latch.

24. The fastener of claim 23, wherein the first position of the pushlever corresponds to the unlocked position of the unlocked position of the lock bolt and the second position of the pushlever corresponds to the locked position of the lock bolt.

25. The fastener of claim 24, wherein the fastener is attached to a window.

26. The fastener of claim 23, wherein the first position of the pushlever corresponds to the locked position of the lock bolt and the second position of the pushlever corresponds to the unlocked position of the lock bolt.

27. The fastener of claim 26, wherein the fastener is attached to a window.

28. The fastener of claim 23, wherein the lock bolt includes a lip portion adapted to engage with an edge of a window frame.

29. The fastener of claim 23, further comprising a keeper and wherein the lock bolt includes a lip portion adapted to engage the keeper.

30. An automatic locking fastener for a window, door, or gate comprising:

a housing having a front opening and a rear opening, a manually operable pushlever in the front opening of the housing, the pushlever having a pair of opposing ends, the pushlever selectively shiftable between a first position wherein the pushlever is substantially within the housing and a second position wherein at least one of the opposing ends protrudes from the housing through the front opening;

means for latching the pushlever in the first position;

means for biasing the pushlever toward the second position;

a lock bolt in the rear opening of the housing, the lock bolt operably coupled with the pushlever and selectively shiftable by the pushlever between a locked position wherein a portion of the lock bolt protrudes through the rear opening of the housing and an unlocked position wherein the lock bolt is substantially within the housing; and means operable through the rear opening of the housing for releasing the latch.

* * * * *

UNITED STATES PATENT AND TRADEMARK OFFICE

CERTIFICATE OF CORRECTION

PATENT NO. : 6,848,728 B2
DATED : February 1, 2005
INVENTOR(S) : Anthony Rotondi et al.

It is certified that error appears in the above-identified patent and that said Letters Patent is hereby corrected as shown below:

Title page,
Item [56], References Cited, U.S. PATENT DOCUMENTS, add:
-- 5,901,501 05/11/1999 Fountaine --.

Column 2,
Line 13, delete "is".

Signed and Sealed this

Fourteenth Day of March, 2006

JON W. DUDAS
*Director of the United States Patent and Trademark Office*